US007748558B2

(12) United States Patent
Rouns

(10) Patent No.: US 7,748,558 B2
(45) Date of Patent: Jul. 6, 2010

(54) BEAR-PROOF LATCH FOR A REFUSE CONTAINER

(76) Inventor: Bart Rouns, 4900 Lower Miller Creek, Missoula, MT (US) 59803-9743

( * ) Notice: Subject to any disclaimer, the term of this patent is extended or adjusted under 35 U.S.C. 154(b) by 1025 days.

(21) Appl. No.: 11/404,210

(22) Filed: Apr. 13, 2006

(65) Prior Publication Data

US 2007/0090114 A1 Apr. 26, 2007

Related U.S. Application Data

(63) Continuation-in-part of application No. 11/189,327, filed on Jul. 26, 2005.

(51) Int. Cl.
*B65D 45/16* (2006.01)

(52) U.S. Cl. ..... 220/326

(58) Field of Classification Search ..... 220/326, 220/324, 908.2, 908.1, 908, 730, 757, 762, 220/DIG. 11, DIG. 13, 210, 848, 845, 827, 220/811, 810, 234, 260, 315, 200, 236, 262; 292/42, 38, 37, 33, 32, 121, 175, 171, 169, 292/163, 137, 3, 95, DIG. 61; D34/7, 1; D9/443, 435

See application file for complete search history.

(56) References Cited

U.S. PATENT DOCUMENTS

| | | | | | |
|---|---|---|---|---|---|
| 1,230,316 | A * | 6/1917 | Napier | 220/811 |
| 1,251,984 | A * | 1/1918 | Losoncy | 220/264 |
| 1,583,433 | A | 5/1926 | Witt | |
| 2,153,916 | A * | 4/1939 | Dunbar | 292/38 |
| 2,311,835 | A * | 2/1943 | Johnson | 312/275 |
| 2,348,843 | A * | 5/1944 | Pearce | 384/190 |
| 3,008,604 | A * | 11/1961 | Garner | 220/87.1 |
| 3,073,144 | A * | 1/1963 | Papanti | 70/211 |
| 3,731,964 | A | 5/1973 | Hyde | |
| 4,214,782 | A | 7/1980 | Boyer | |
| 4,691,840 | A | 9/1987 | Ferbrache | |
| 5,102,001 | A | 4/1992 | Teague et al. | |
| 5,222,619 | A | 6/1993 | Gregory | |
| 5,224,744 | A | 7/1993 | Michelutti | |
| 5,474,341 | A | 12/1995 | Putman et al. | |
| 5,490,606 | A | 2/1996 | Lombardo | |
| 5,772,264 | A | 6/1998 | Bettenhausen | |
| 6,880,717 | B1 | 4/2005 | O'Conor | |
| 2005/0017006 | A1 * | 1/2005 | Kuo | 220/263 |
| 2005/0218142 | A1 * | 10/2005 | Finnestad et al. | 220/264 |
| 2006/0032860 | A1 * | 2/2006 | Hase | 220/831 |
| 2007/0045319 | A1 * | 3/2007 | Hogan | 220/288 |

* cited by examiner

*Primary Examiner*—Anthony Stashick
*Assistant Examiner*—Robert J Hicks
(74) *Attorney, Agent, or Firm*—Jean Kyle

(57) ABSTRACT

A latch plate slides along a slide plate attached to the body of a refuse container. The latch plate engages a pin on the hinged lid of the container to lock it closed. The plates are spring-biased to keep the container locked. The plates must be moved against the spring to open the lid. The lid can be opened by actuating at least two trigger mechanisms. Rods depressed by the tongs of a garbage truck during pick-up pull cables that overcome the springs disengaging each latch plate from the pins unlocking the lid of the container. Requiring simultaneous actuation of at least two trigger mechanisms makes the latch bear resistant.

21 Claims, 10 Drawing Sheets

BEAR-PROOF LATCH FOR A REFUSE CONTAINER

CROSS REFERENCE TO RELATED APPLICATIONS

This application is a continuation-in-part of co-pending application Ser. No. 11/189,327, filed Jul. 26, 2005. The disclosure of this application is hereby incorporated by reference in its entirety, including all figures, tables and drawings.

BACKGROUND OF THE INVENTION

As the world's population continues to grow humans encroach further into wildlife habitat. Wildlife is forced to adapt to living around humans, and, likewise, humans must adapt to living around wildlife. Wildlife and humans are discouraged however from living together. For example, a popular adage is "a fed bear is a dead bear." Access to full garbage cans by bears or other wildlife is dangerous to both the bears and the humans. A variety of latches have therefore been designed to discourage wildlife from opening a garbage or refuse container. Devices have been designed that simply reconfigure the lid or the handle of a garbage can to lock the can closed (see, for example, U.S. Pat. Nos. 4,214,782; and 4,691,840). Mechanical latches are available for both single household refuse containers or residential garbage carts (U.S. Pat. Nos. 1,583,433; 3,731,964; 5,102,001; and 6,880,717 B1) and multiple household dumpsters (U.S. Pat. Nos. 5,222,619; and 5,490,606). Gravity based locking mechanisms have been designed to address the issue of automated garbage pick-up (U.S. Pat. Nos. 5,224,744; 5,474,341; and 5,772,264). Many latches are available to lock refuse containers, these latches however are often complicated and not designed to thwart wildlife. A need remains for a latch that is both simple in design and sturdy enough to discourage all animals, including bears.

All patents, patent applications, provisional patent applications and publications referred to or cited herein, are incorporated by reference in their entirety to the extent they are not inconsistent with the explicit teachings of the specification.

BRIEF SUMMARY OF THE INVENTION

The invention involves a latch for a refuse container or residential garbage cart that cannot be foiled by a grizzly bear. The latch has a rotatable handle that when turned slides one plate over another unlocking the latch by releasing pins attached to the lid of the refuse container. The plates are spring-biased in a locked position. To open the container the latch must be opened against the spring. The subject latch is configured for both manual operation and automated operation triggered to open upon being lifted by a garbage truck.

DETAILED DESCRIPTION OF THE INVENTION

Figure 1:
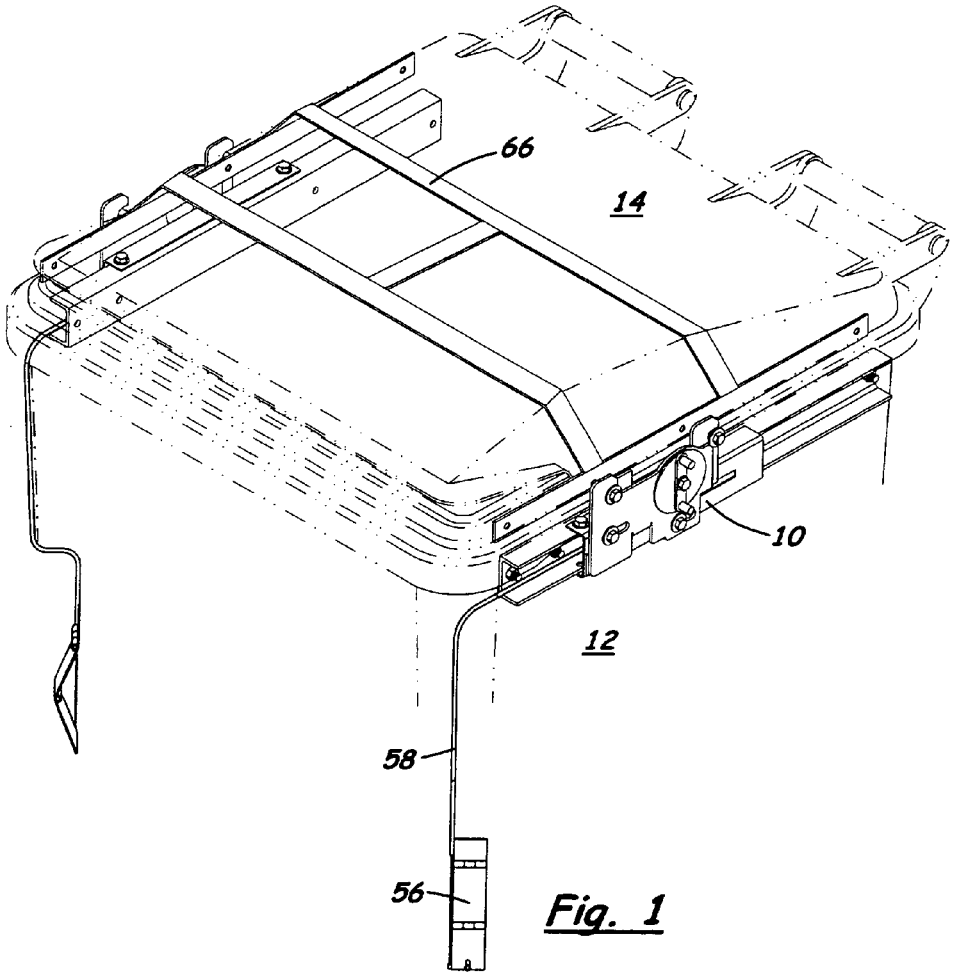
FIG. 1 is a top perspective view of a preferred embodiment of the latch of the subject invention on a refuse container.

The bear-proof latch of the subject invention can be configured to be opened manually by a single user or to be opened automatically during automated pick-up by a garbage truck. The latch 10 is applied to a refuse container having a body 12 and a hinged lid 14. A latch plate 16 slides upon a slide plate 18 upon rotation of a handle 20. The latch plate 16 has at least one notch 22 that engages at least one pin 24 on the hinged lid 14 to secure the lid to the body 12 of the refuse container. The latch plate is biased to the slide plate by a spring so that notch in the latch plate engages the pin on the hinged lid and the lid is locked to the body of the container. To open the container the latch plate must be slid along the slide plate against the spring.

In the exemplified embodiments, the slide plate 18 is connected to the body 12 of the refuse container by a channel 26. The channel is bolted to the container body and the slide plate is bolted to the channel. The channel 26 provides a sturdy means by which to connect the slide plate to the container. Further, the subject embodiment is designed to be retrofitted to existing containers. The channel allows the position of a retrofitted latch to be adjusted on varying sizes of refuse containers.

Figure 5:
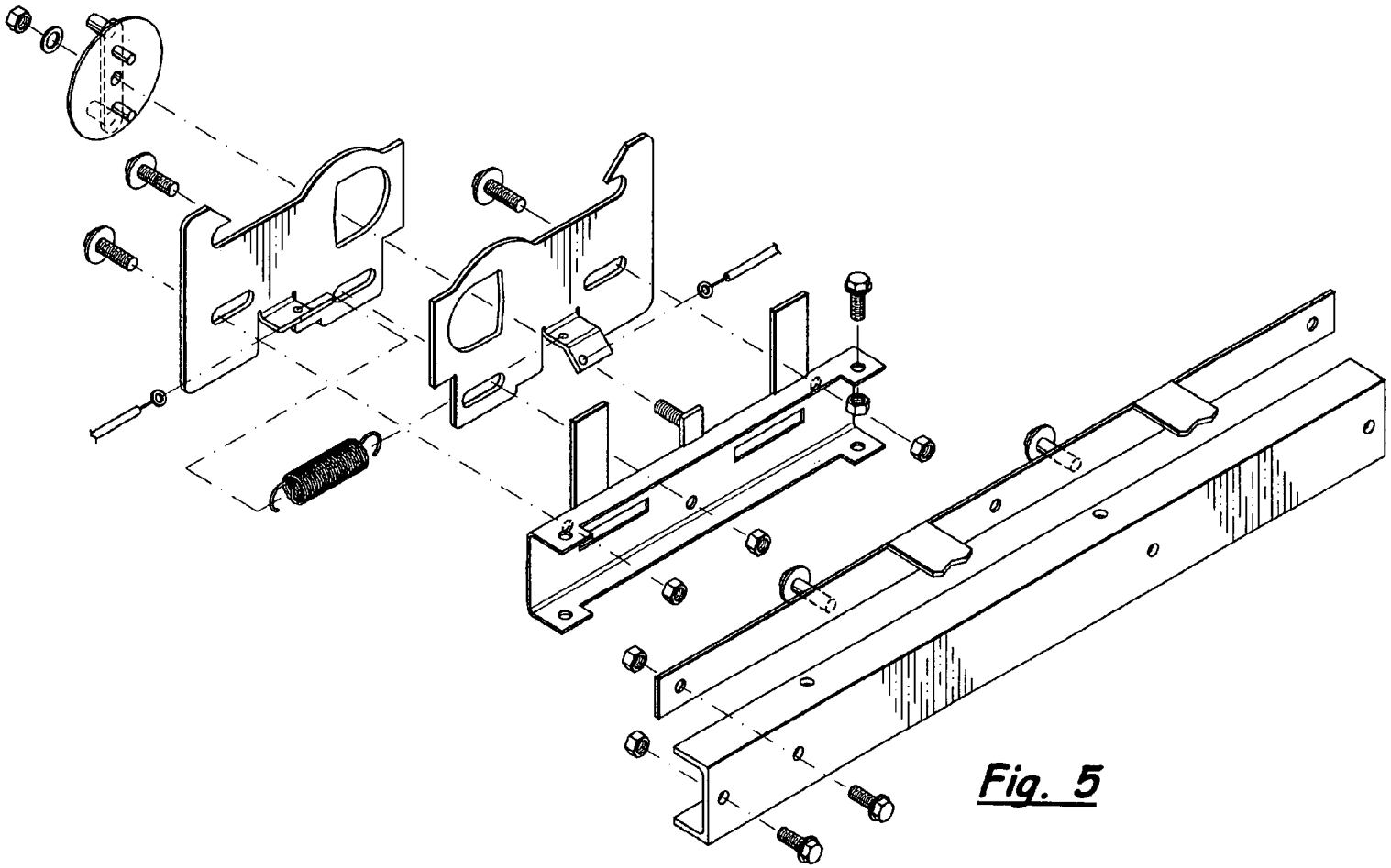
FIG. 5 is a exploded view of the latch shown in FIG. 3 including mounting means.
Figure 6:
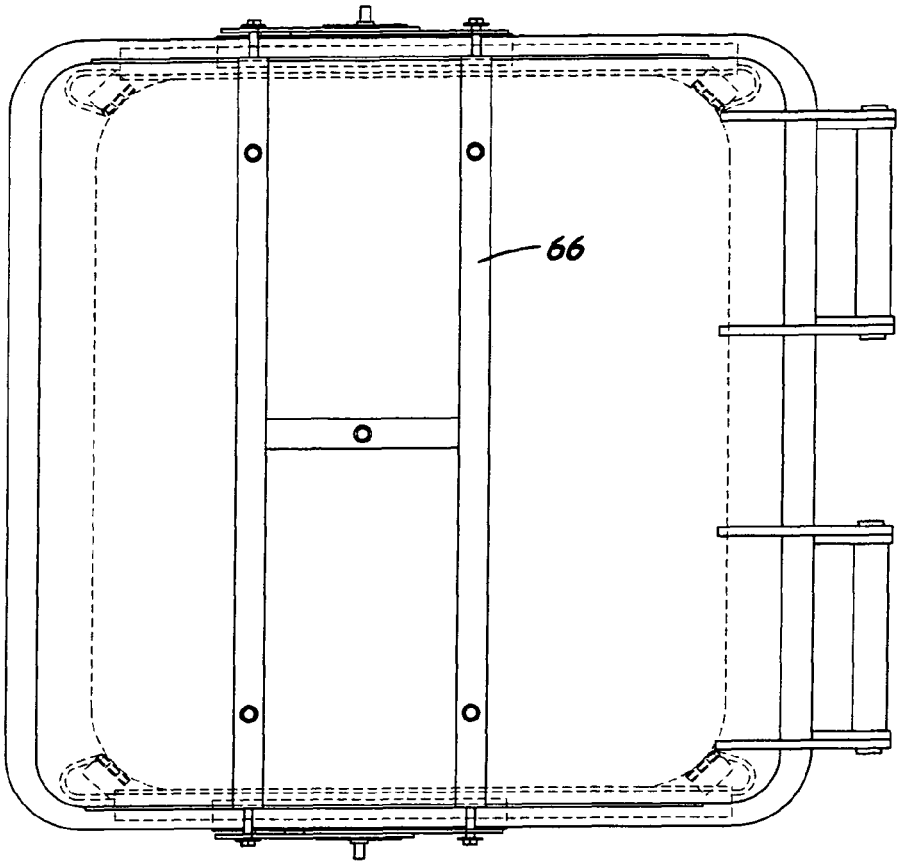
FIG. 6 is a top elevational view of another preferred embodiment of the latch of the subject invention showing placement of the trigger mechanisms.
Figure 8:
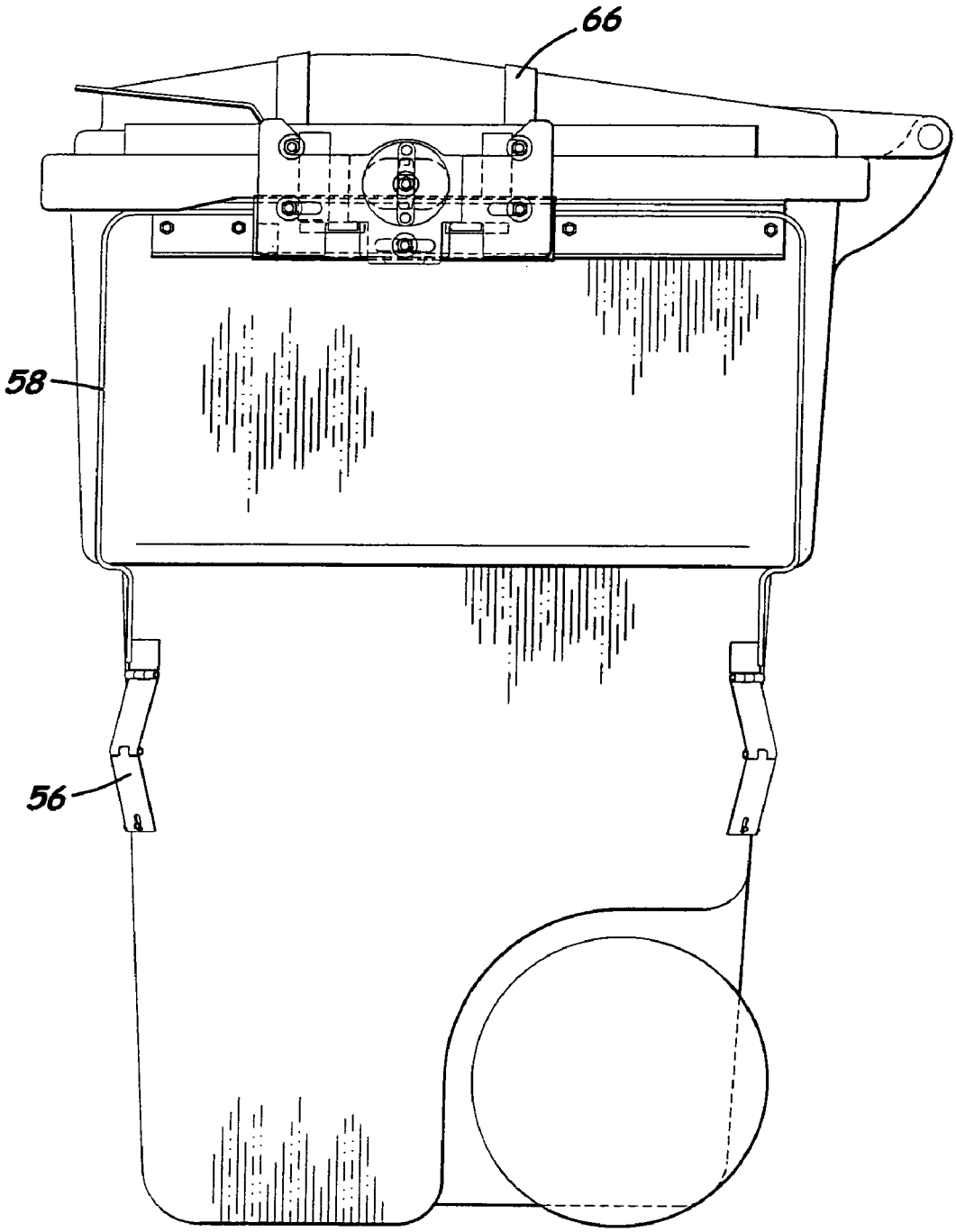
FIG. 8 is a side elevational view of a preferred embodiment of the latch of the subject invention shown on a refuse container in a latched or locked position, the figure showing the internal working mechanisms of the latch.

The slide plate 18 slideably supports and guides the latch plate 16. An exemplified embodiment of the slide plate of the latch of the subject invention is shown in FIG. 5. The slide plate has a long body 30 along which the latch plate slides. Stops 32, 34 extend from the body to abut pins 24 on the lid 14 of the refuse container when the lid is closed (FIGS. 1 and 8). The body 30 has a track 36 to receive flanges of the latch plate and provides posts 40 upon which the latch plate slides. Means to connect a rotatable handle 31 to the body of the slide plate are further provided.

The latch plate 16 has slots 42, 44 to receive the posts 40 of the slide plate 18. The latch plate further has an asymmetric aperture 46 to receive the handle 20. Flanges 48 bent perpendicular to the plane in which the plates slide engage the track 36 in the slide plate 18. The latch plate has a notch 22 to engage the pin on the lid of the refuse container.

The slide plate 18 and the latch plate 16 shown in the exemplified embodiments are designed to be simple and sturdy. Further the plates are configured to lack areas which an animal could hook a tooth or a claw to pry the latch apart. It would be apparent however to those skilled in the art that the slide plate and the latch plate can be configured many ways. It is necessary only that the plates are slidably secured and provide a means to capture and lock the hinged lid.

Figure 2A:
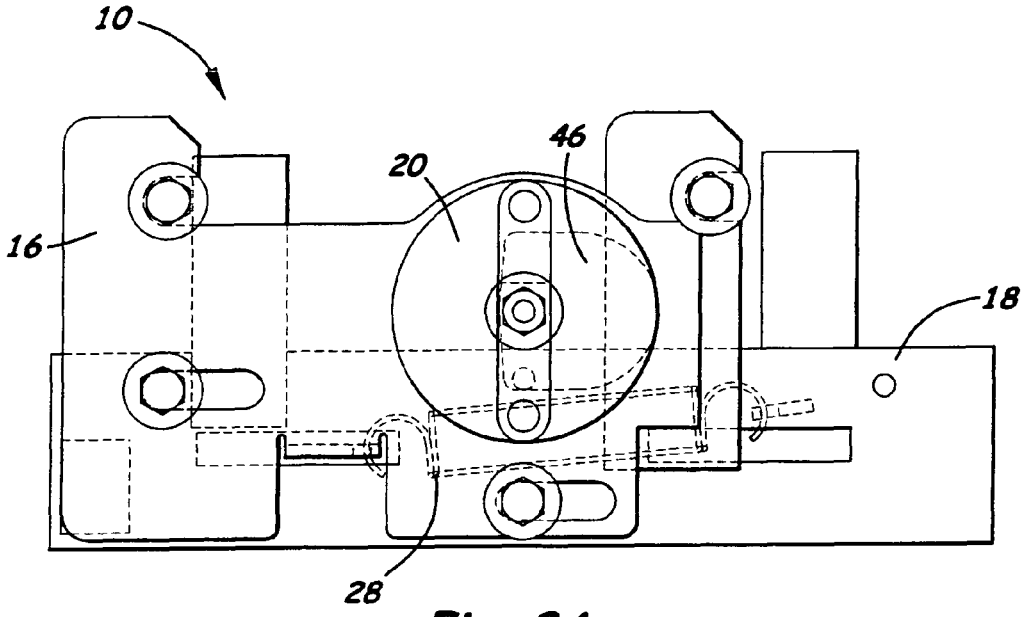
FIG. 2A is a side elevational view of the latch shown in FIG. 1 in the latched or locked position which shows the internal working mechanisms of the latch.
Figure 2B:
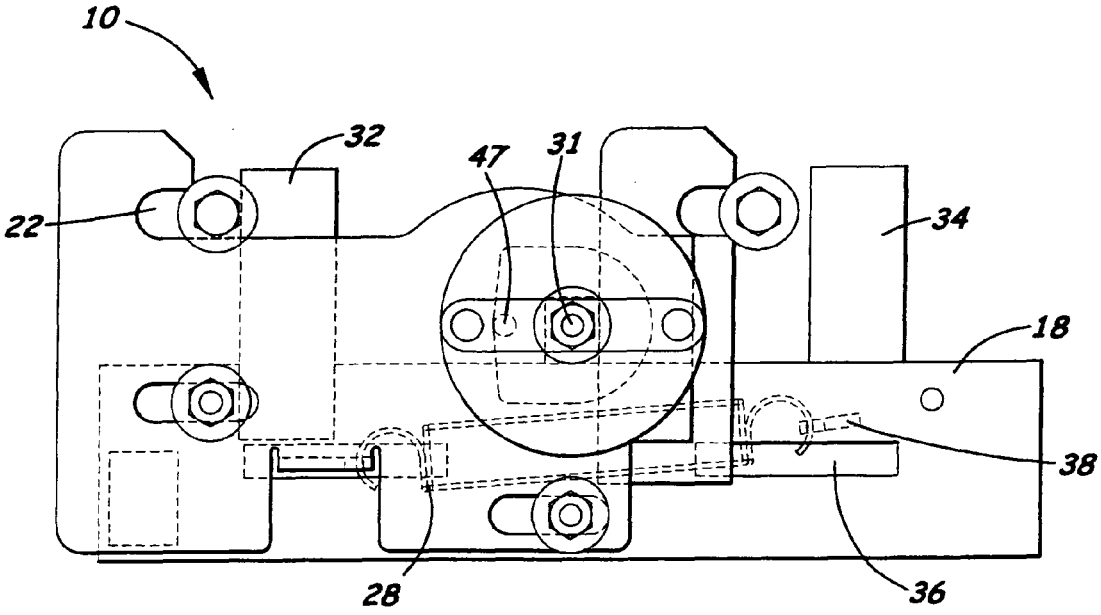
FIG. 2B is a side elevational view of the latch shown in FIG. 1 in the unlatched or open position which shows the internal working mechanisms of the latch.
Figure 3:
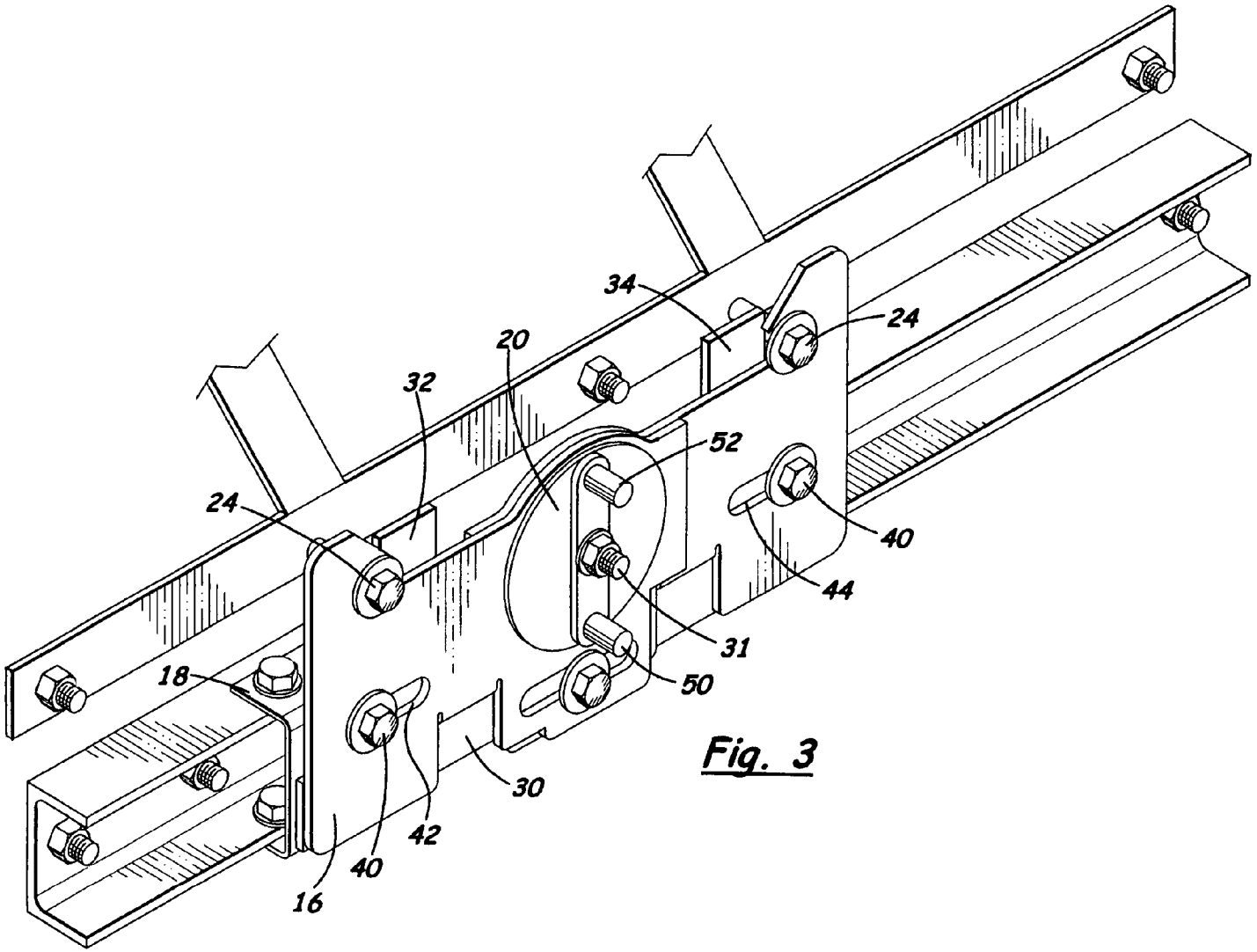
FIG. 3 is a perspective view of another preferred embodiment of the latch of the subject invention mounted on mounting means.

The plates of the latch of the subject invention are spring-biased to latch or lock the hinged lid of the container to the body of the container. To open and release the hinged lid, a user must overcome the spring. The subject latch is presented in several embodiments. A latch that is intended to be opened manually is shown in FIGS. 2A and 2B. The manual latch uses a rotating handle 20 to move a single latch plate 16 over the slide plate 18. The latch has a single spring 28. The spring 28 is attached to a flange 48 on the latch plate 16 and a cleat 38 on the slide plate 18. A pin 54 on the backside of the handle 20 presses against a wall of the asymmetric aperture 46 in the latch plate 16 to slide the plate along the slide plate 18. Movement of the latch plate relative to the slide plate causes the notches 22 in the latch plate to disengage the pins 24 on the hinged lid unlocking the lid from the body of the container. In a preferred embodiment, an indent 47 in the wall of the asymmetrical aperture 46 catches the pin 54 to hold the handle and latch in the open position.

The handle 20 must be rotated against a spring-bias to open the latch. Rotating a handle is difficult for an animal to accomplish. The handle can be any configuration requiring rotation as long as the handle does not allow the animal to, for example, hook a tooth or claw and rotate the handle. In a preferred embodiment, the handle is a flat, circular disk. Opposing pegs 50, 52 provide grips for a hand with opposable thumbs to rotate the handle but cannot be hooked by a tooth or claw.

Figure 7A:
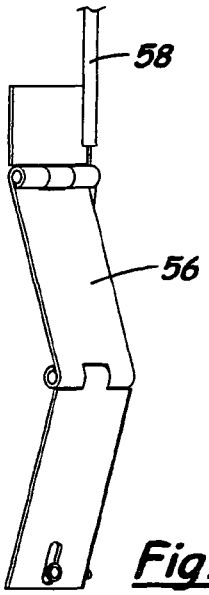
FIG. 7A is a perspective view of a preferred embodiment of a trigger mechanism for the latch of the subject invention.
Figure 7B:
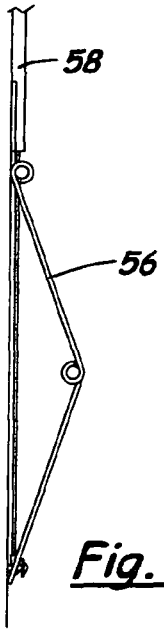
FIG. 7B is a side elevational view of a preferred embodiment of the trigger mechanism for the latch of the subject invention shown in FIG. 7A.

Other preferred embodiments of the latch of the subject invention allow the latch to be opened when grabbed for automatic pick-up by a garbage truck. FIG. 1 shows a preferred embodiment of such a latch. During automatic pick-up by a garbage truck, the lid is released from the container when the garbage truck actuates trigger mechanisms that open the latch. A preferred embodiment of the trigger mechanisms useful on the latch of the subject invention is shown in FIGS. 7A and 7B. A garbage truck grabs a typical 95 gallon garbage cart with tongs that encircle the cart. The tongs grab the cart at about mid-body. The preferred embodiment places pressure sensitive triggers in at least two positions on the body. In this preferred embodiment, the trigger 56 is a simple hinge that when depressed pulls a cable 58 attached to the flange 48 of the latch plate pulling the latch plates along the slide plate against the spring to release the pins on the lid of the garbage cart. In this embodiment, the cable 58 is connected directly to the flange 48. Requiring that at least two mechanisms be triggered to open the latch decreases the likelihood an animal could open the container.

Figure 11:
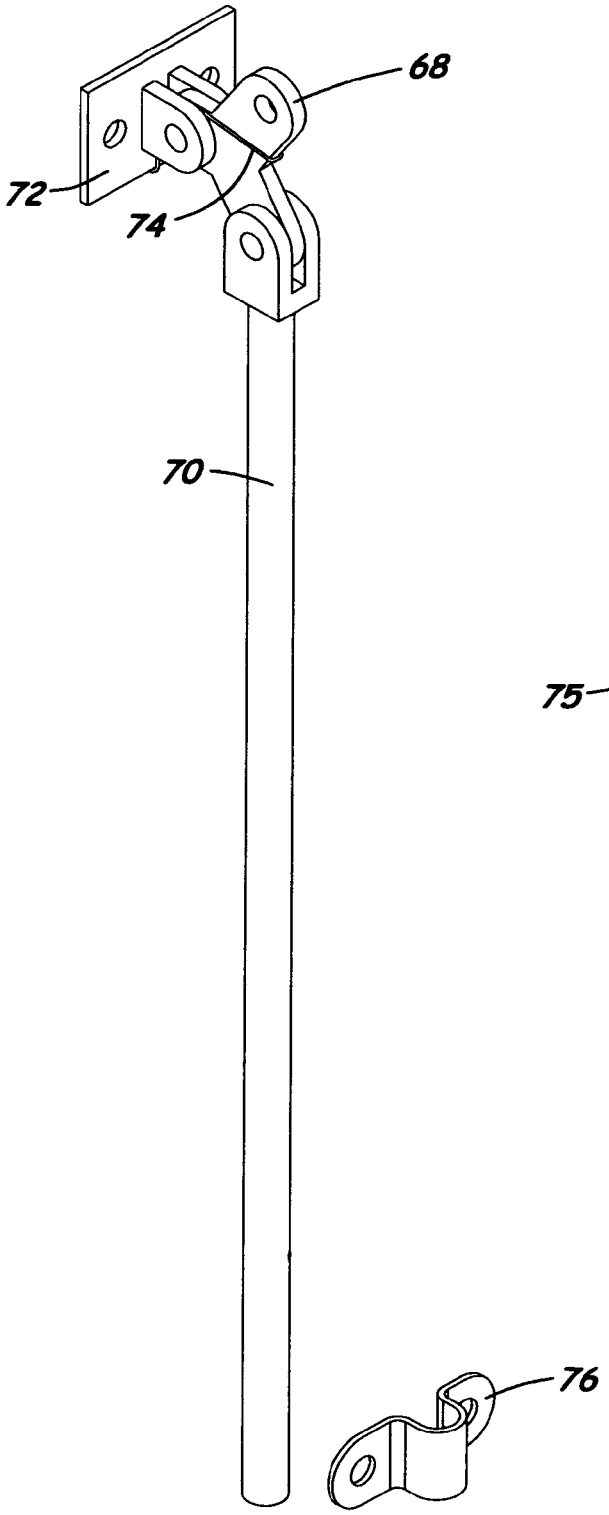
FIG. 11 is a perspective view of another preferred embodiment of a trigger mechanism for the latch of the subject invention.
Figure 13:
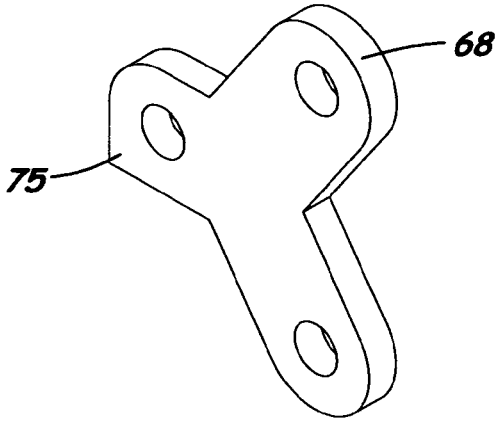
FIG. 13 is a side elevational view of the Y-shaped pivot of the trigger mechanism shown in FIG. 11.
Figure 12:
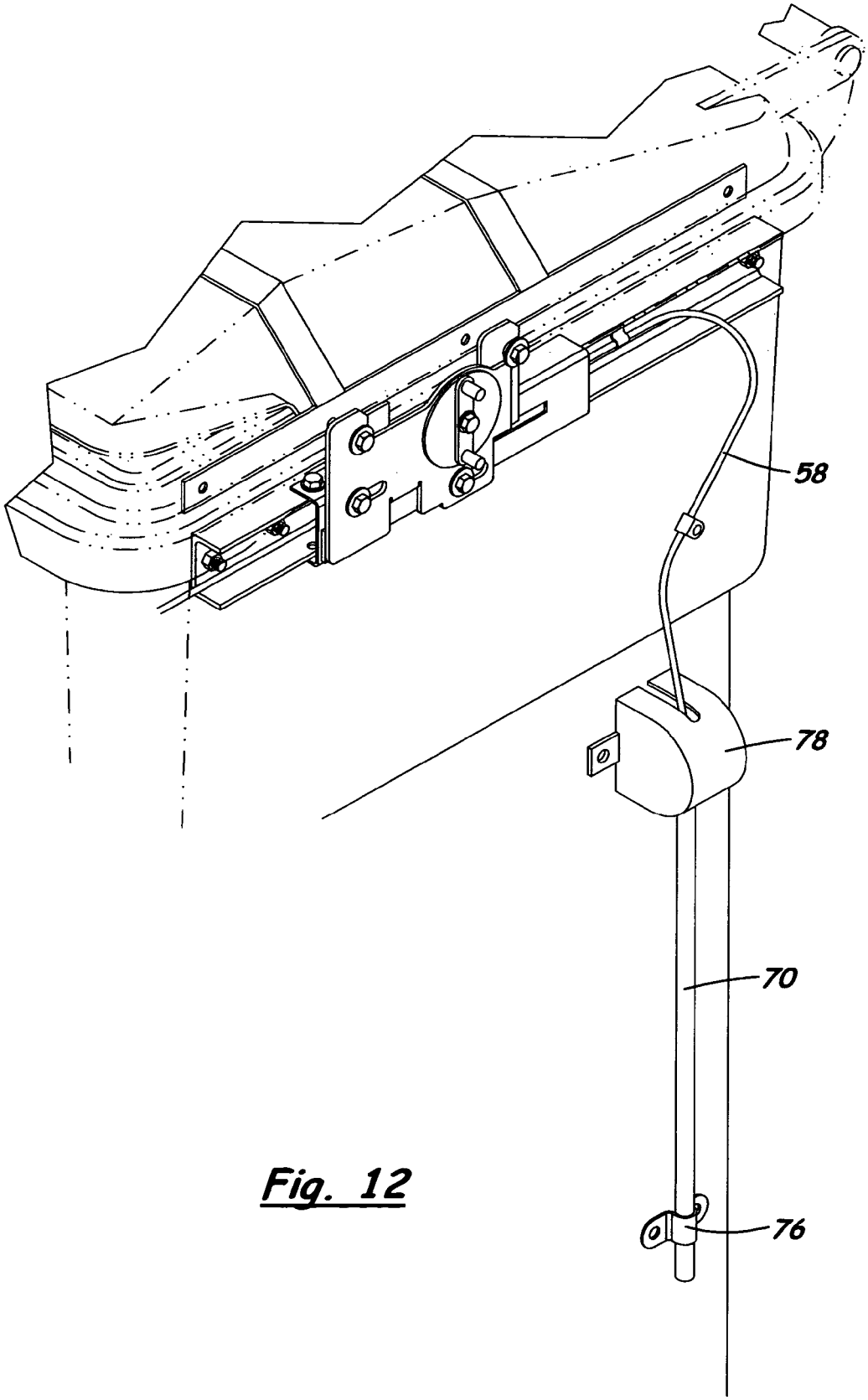
FIG. 12 is a side elevational view of the trigger mechanism shown in FIG. 11 with a preferred embodiment of the latch of the subject invention shown on a refuse container.

Another preferred embodiment of a trigger mechanism for a latch of the subject invention that opens during automatic pick-up of the refuse container by a garbage truck is shown in FIGS. 11-13. This embodiment has rugged components to withstand numerous encounters with a garbage truck. The trigger mechanism comprises a Y-shaped pivot lever 68. A rod 70 is connected to one ear of the Y-shaped pivot and a cable 58 is connected to the other ear. The cable is attached to the latch plate of the subject latch. Moving the rod 70 rocks the pivot 68 pulling the cable 58 to slide the latch plate along the slide plate against the spring to release the pins on the lid of the garbage can and unlock the can. In the exemplified embodiment, the rod 70 is mounted to the body of the refuse container by a mounting bracket 72 that pivotally supports the pivot 68. A spring 74 retains the pivot in a neutral position where the cable is not under tension and the rod is freely moved. A stop 75 on the tail of the Y-shaped pivot 68 prevents the pivot from over rotation. The rod 70 is rotatably connected to the pivot by a clevis. The end of the rod distal the pivot is captured by a rod guide 76 mounted to the body of the refuse container. The rod guide 76 contains and supports the rod as it is moved, in this case, depressed against the side of the refuse container, by the tongs of a garbage pick-up truck. Preferably, a guard 78 is placed over the pivot to protect it from the claws and teeth of a bear.

Figure 4A:
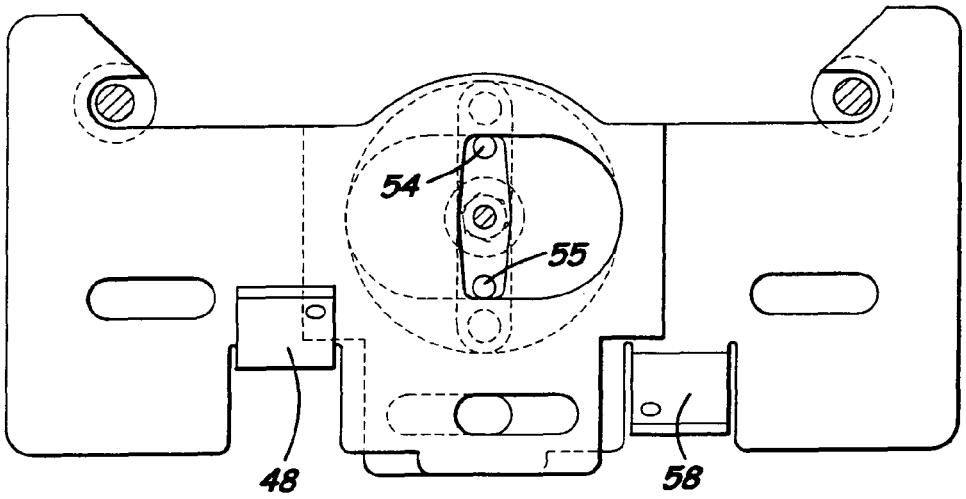
FIG. 4A is a side elevational view of the latch shown in FIG. 3 in the latched or locked position which shows the internal working mechanisms of the latch.
Figure 4B:
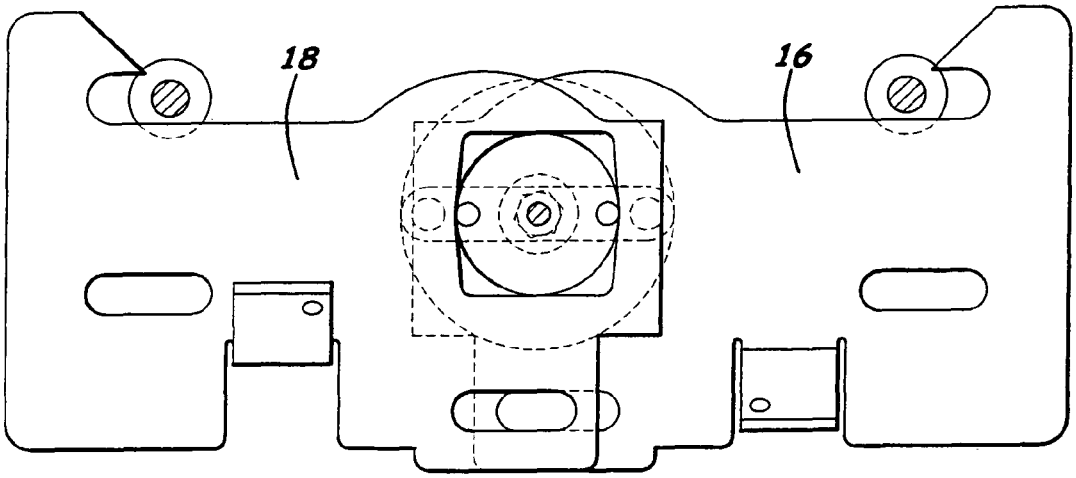
FIG. 4B is a side elevational view of the latch shown in FIG. 3 in the unlatched or open position which shows the internal working mechanisms of the latch.
Figure 9:
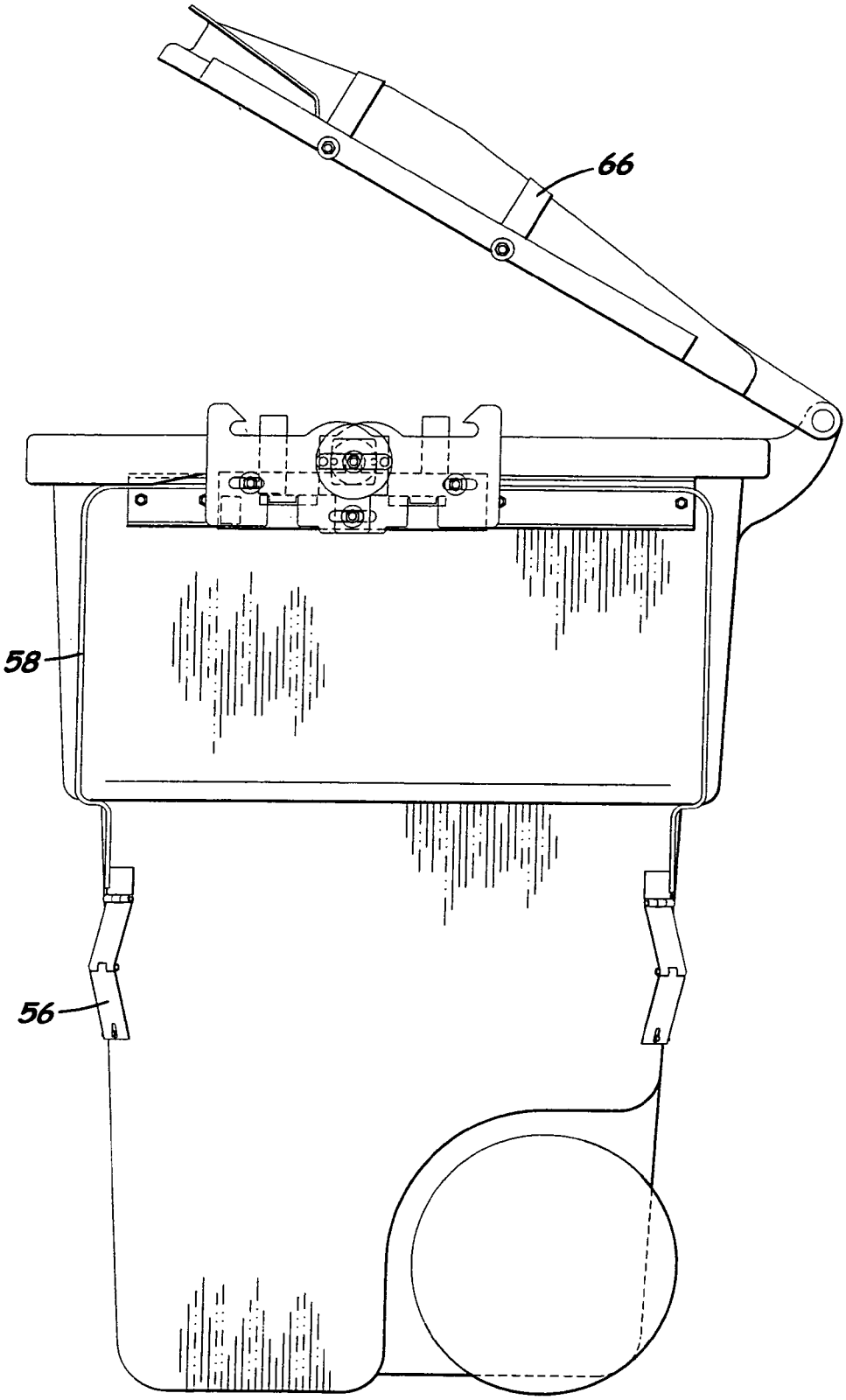
FIG. 9 is a side elevational view of the preferred embodiment of the latch shown in FIG. 8 in a unlatched or open position, the figure showing the internal working mechanisms of the latch.

Another preferred embodiment of the latch of the subject invention that opens upon pick-up by a garbage truck is shown in FIGS. 8 and 9. This embodiment uses two latch plates that slide along a single slide plate (FIGS. 4A and 4B). The latch plates are biased toward one another by the spring 28 in the closed or locked position. Rotation of the handle 20 causes opposing pins 54, 55 to contact the asymmetrical aperture 46 on each plate and drive the plates apart. The notch 22 on each latch plate disengages the pins 24 on the lid to open the container.

Figure 10:
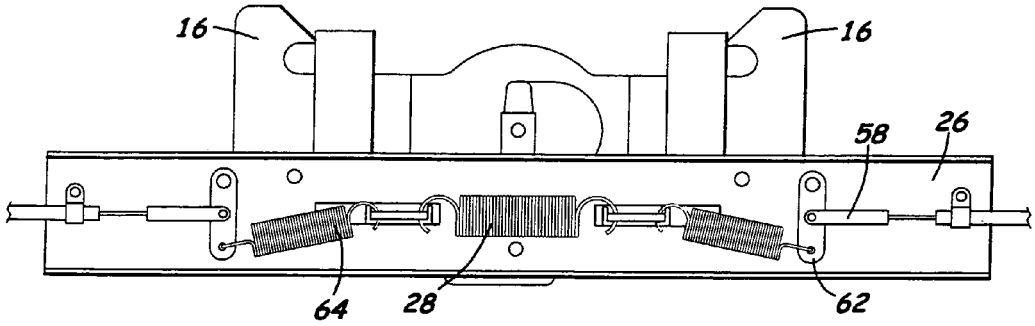
FIG. 10 is a side elevational view of another preferred embodiment of the latch of the subject invention.

Automatic pick-up by the tongs of a garbage truck actuates trigger mechanisms placed at each corner of the can. Actuating these trigger mechanisms pulls the plates apart releasing the pins to open the can. Upon release of the trigger by the truck the latch closes. The trigger mechanism previously describe are applicable to this embodiment, likewise, one skilled in the art would be able to device a number of trigger mechanisms to pull the plates apart and release the lid. A particularly preferred embodiment of a trigger mechanism however is shown in FIG. 10. This embodiment has a trigger 56 attached to a cable 58 like the previously described embodiment but the cable 58 is attached to the flange 48 through a pivot 62 and a spring 64. The subject embodiment assists in resetting the trigger upon release by the tong of the garbage truck.

Individual pick-up of garbage from rural customers is a luxury. Previously customers were required to take their garbage to a dumping station. Automated pick-up has made rural pick-up more cost effective. Cost efficiency is lessened however if the driver of the garbage truck or a second individual has to leave the truck to unlatch the lid of each cart. The automatic embodiments of the latch of the subject invention allows a single worker to empty a rural residential garbage cart without leaving the truck.

The pins 24 on the lid 14 of the refuse container are captured by the latch plate 16. The pins 24 can be integral to the container or applied to the container. The exemplified embodiment of the latch of the subject invention is designed to be bear-proof. Therefore, in this embodiment, the pins 24 are provided on a steel cage 66 applied to the lid of the refuse container. The cage 66 provides added support to the container and is easily retrofitted to existing containers.

The latch of the subject invention is designed to thwart bears from opening a refuse container. Therefore, the subject latch has been configured so that no surfaces are presented that a bear can claw open or chew on. For example the shape of the channel 26 mates with the slide plate 18 to enclose the spring 28. The handle 20 is flat against the latch plate 16 so it cannot be pried from the latch. Further, the subject latch is most effectively applied to refuse containers that themselves can withstand the teeth and claws of a bear. Research into the best materials and design for constructing such a container is extensive and outside the scope of this document. Several residential garbage carts have been certified bear-proof and would be appropriate for use in conjunction with the latch of the subject invention. These containers include, but are not limited to, wheeled carts by IPL, Inc. (Quebec, Canada) and residential garbage carts by Otto Environmental Systems (Eloy, Ariz.).

The latch of the subject invention applied to a 95 gallon trash cart (MSD-95, Otto Environmental Systems) was successfully tested and certified bear resistant by the Living with Wildlife Foundation. To prepare the cart and latch for testing, the cart was baited with tuna and the exterior of the latch was smeared with peanut butter. The baited cart was then placed in an enclosure with 2-3 captive grizzly bears for a minimum of 90 minutes. The latch passed the test by withstanding biting, clawing, rolling and crushing by the bears during that period.

It is understood that the foregoing examples are merely illustrative of the present invention. Certain modifications of the articles and/or methods employed may be made and still achieve the objectives of the invention. Such modifications are contemplated as within the scope of the claimed invention.

The invention claimed is:

1. A latch for a refuse container with a body and a hinged lid, the latch comprising:

a slide plate rigidly attached to the body of the container, a body of the slide plate having at least one slot;

at least one latch plate comprising at least one flange to insert in the at least one slot the at least one flange moving within the at least one slot to slideably engage the slide plate; each of the at least one latch plates having at least one notch to engage at least one pin on the hinged lid of the container;

at least one spring connected to each of the at least one latch plates to hold each latch plate so the at least one notch engages at least one of the at least one pins locking the lid to the body of the container; and means to slide each of the at least one latch plates across the slide plate;

wherein the sliding means comprises at least one cable attached to each of the at least one latch plates and at least one trigger mechanism to move at least one of the at least one cables, the trigger mechanism comprising a rod connected to the at least one cable through a pivot;

wherein movement of the rod causes each of the at least one cables to slide each of the at least one latch plates across the slide plate applying positive force to spring each of the at least one springs so the at least one notch disengages the at least one pin unlocking the lid from the body of the container.

2. The latch of claim 1, wherein said pivot is Y-shaped and said at least one cable is attached to one ear of the Y and said rod is attached to the other ear of the Y.

3. The latch of claim 1, wherein said slide plate is attached to said body of said container by a channel.

4. The latch of claim 1, wherein said at least one pin is connected to a cage which is attached to said lid of said container.

5. The latch of claim 1, wherein said means to slide each of said at least one latch plates across said slide plate further comprises a rotatable handle.

6. The latch of claim 5, wherein said rotatable handle is a disk with at least one peg projecting from a surface of the disk.

7. The latch of claim 1, comprising one latch plate with two notches.

8. A latch for a refuse container with a body and a hinged lid, the latch comprising:

a slide plate rigidly attached to the body of the container a body of the slide plate having at least one slot;

two latch plates each latch plate comprising at least one flange to insert in the at least one slot the at least one flange moving within the at least one slot to slideably engage the slide plate; each latch plate having at least one notch to engage at least one pin on the hinged lid of the container;

a spring connecting the latch plates to hold the latch plates so the at least one notch engages the at least one pin locking the lid to the body of the container; and means to slide each latch plate across the slide plate;

wherein the sliding means comprises at least one cable attached to each latch plate and at least one trigger mechanism to move at least one of the at least one cables, the trigger mechanism comprising a rod connected to the at least one cable through a pivot;

wherein movement of the rod causes each of the at least one cables to slide each latch plate across the slide plate applying positive force to spring the spring so the at least one notch disengages the at least one pin unlocking the lid from the body of the container.

9. The latch of claim 8, wherein said pivot is Y-shaped and said at least one cable is attached to one ear of the Y and said rod is attached to the other ear of the Y.

10. The latch of claim 8, wherein said slide plate is attached to said body of said container by a channel.

11. The latch of claim 8, wherein said at least one pin is connected to a cage which is attached to said lid of said container.

12. The latch of claim 8, wherein said means to slide each latch plate across said slide plate further comprises a rotatable handle.

13. The latch of claim 12, wherein said rotatable handle is a disk with at least one peg projecting from a surface of the disk.

14. The latch of claim 8, wherein said at least one cable is attached to each latch plate through a pivot and a spring.

15. A lockable refuse container comprising:

a body;

a hinged lid; and a latch, the latch comprising; a slide plate rigidly attached to the body of the container, a body of the slide plate having at least one slot, two latch plates each latch plate comprising at least one flange to insert in the at least one slot the at least one flange moving within the at least one slot to slideably engage the slide plate, each latch plate having at least one notch to engage at least one pin on the hinged lid of the container, a spring connecting the latch plates to hold the latch plates so the at least one notch engages the at least one pin locking the lid to the body of the container, and means to slide each latch plate across the slide plate, the sliding means comprising at least one cable attached to each latch plate and at least one trigger mechanism to move at least one of the at least one cables, the trigger mechanism comprising a rod connected to the at least one cable through a pivot, wherein movement of the rod about the pivot causes each of the at least one cables to slide each latch plate across the slide plate applying positive force to spring the spring so the at least one notch disengages the at least one pin unlocking the lid from the body of the container.

16. The latch of claim 15, wherein said pivot is Y-shaped and said at least one cable is attached to one ear of the Y and said rod is attached to the other ear of the Y.

17. The latch of claim 15, wherein said slide plate is attached to said body of said container by a channel.

18. The latch of claim 15, wherein said at least one pin is connected to a cage which is attached to said lid of said container.

19. The latch of claim 15, wherein each means to slide said latch plate across said slide plate further comprises a rotatable handle.

20. The latch of claim 19, wherein said rotatable handle is a disk with at least one peg projecting from a surface of the disk.

21. The latch of claim 15, wherein said at least one cable is attached to each latch plate through a pivot and a spring.

* * * * *